US006116991A

United States Patent [19]

Liu et al.

[11] Patent Number: 6,116,991

[45] Date of Patent: Sep. 12, 2000

[54] INSTALLATION FOR IMPROVING CHEMICAL-MECHANICAL POLISHING OPERATION

[75] Inventors: Ying-Chih Liu, Ping Tung Hsien; Sen-Nan Lee, Hsinchu, both of Taiwan

[73] Assignee: Worldwide Semiconductor Manufacturing Corp., Hsinchu, Taiwan

[21] Appl. No.: 09/200,364

[22] Filed: Nov. 25, 1998

[30] Foreign Application Priority Data

Aug. 28, 1998 [TW] Taiwan ..... 87114257

[51] Int. Cl.[7] ..... B24B 1/00

[52] U.S. Cl. ..... 451/285; 451/287; 451/288; 451/446

[58] Field of Search ..... 451/36, 37, 41, 451/59, 60, 285, 287, 288, 446; 438/692, 693, 691; 156/345

[56] References Cited

U.S. PATENT DOCUMENTS

| | | | |
|---|---|---|---|
| 5,435,772 | 7/1995 | Yu | 451/288 |
| 5,503,590 | 4/1996 | Saitoh et al. | 451/11 |
| 5,503,592 | 4/1996 | Neumann | 451/278 |
| 5,558,563 | 9/1996 | Cote et al. | 451/285 |
| 5,769,699 | 6/1998 | Yu | 451/41 |
| 5,904,609 | 5/1999 | Fukuroda et al. | 451/41 |
| 5,913,713 | 6/1999 | Cheek et al. | 451/41 |
| 5,931,719 | 8/1999 | Nagahara et al. | 451/41 |
| 5,944,583 | 8/1999 | Cruz et al. | 451/41 |

*Primary Examiner*—Eileen P. Morgan
*Attorney, Agent, or Firm*—Jiawei Huang; J. C. Patents

[57] ABSTRACT

A chemical-mechanical polishing station comprises a polishing table that has concentric rings. The rings are separated from each other by a small gap and all rings are capable of rotating in the same prescribed direction. A polishing pad is mounted on top of each ring, and a delivery tube is positioned at a distance above the polishing pads. The delivery tube further includes a tube handle and a tube surface, and the tube surface has a plurality of holes drilled in it for delivering slurry to the polishing pad surface. Each concentric ring of the polishing table is able to rotate such that all the rings have the same tangential polishing speed. Therefore a wafer surface can be more uniformly polished. Moreover, material having different density, roughness and chemical composition can be chosen to fabricate the polishing pads so that an even better polishing result can be obtained.

9 Claims, 2 Drawing Sheets

INSTALLATION FOR IMPROVING CHEMICAL-MECHANICAL POLISHING OPERATION

CROSS REFERENCE TO RELATED APPLICATION

This application claims the priority benefit of Taiwan application serial no. 87114257, filed Aug. 28, 1998, the full disclosure of which is incorporated herein by reference.

BACKGROUND OF THE INVENTION

1. Field of Invention

The present invention relates to a chemical-mechanical polishing (CMP) station. More particularly, the present invention relates to a chemical-mechanical polishing station that has a polishing table capable of improving the uniformity of a polished surface of a wafer.

2. Description of Related Art

As the level of integration of semiconductor devices continues to increase, designs having two or more metallic layers for interconnecting additional MOS transistors brought about by device miniaturization are quite common. Normally, the metal interconnect structures are isolated by inter-layer dielectrics (ILD) or inter-metal dielectrics (IMD). When devices are miniaturized, the corresponding design rules for producing the ILD or the IMD layer are also more restrictive. For example, the degree of planarization necessary on the surface of an ILD or an IMD layer is correspondingly higher.

In order to simplify the fabrication of multiple-level metallic interconnects and to increase accuracy of conductive line pattern transfer, planarization of a wafer to remove surface undulation is very important. The degree to which a wafer is planarized is a critical factor in the precise alignment of a photomask. If the wafer is not properly planarized a computerized system will be unable to align the photomask correctly, resulting in a considerable increase in the probability of processing errors.

In the manufacturing of semiconductor devices, surface planarization is an important step in preparing a wafer for high-resolution photolithographic processing. Only a smooth surface with little height variation can prevent diffraction of light from a light source when a pattern is transferred. In general, planarization techniques include a spin-on-glass (SOG) method and a chemical-mechanical polishing method.

However, in the sub-half-micron device era, the spin-on-glass method of planarization is incapable of providing the degree of planarity required by photolithographic operation. Consequently, chemical-mechanical polishing has become the chief method of providing global planarization up to the level of planarity required for fabricatiing devices in very-large scale integration (VLSI) or even ultra-large scale integration (ULSI) circuits.

Chemical-mechanical polishing (CMP) is a technique of planarizing wafer surfaces using mechanical polishing together with a suitable chemical reagent. Generally, the chemical reagent used in the polishing operation is called a slurry or a polishing solution. The slurry for carrying out a CMP operation is usually colloidal silica or a solution of dispersed alumina in an alkaline media such as potassium hydroxide (KOH) or ammonium hydroxide ($NH_4OH$). The hard alumina or silica particles within the slurry have sizes ranging from 0.1 to 2.0 $\mu$m. Principally, the surface of a wafer is polished using these hard particles suspended within the slurry. In addition, the slurry is also filtered before it is transported to the polishing pad of the CMP station. Filtering the slurry helps to remove any impurities that may cause unnecessary scratching damage to the wafer surface.

FIGS. 1A and 1B are top and side views of a conventional chemical-mechanical polishing station. As shown in FIGS.1A and 1B, the station includes a polishing table 10, a wafer holder 11 for grasping a wafer 12, a polishing pad 13 over the polishing table 10, a tube 14 for carrying slurry 15 to the polishing pad 13, a liquid pump 16 for pumping slurry 15 to the tube 14, and a conditioner 17 for dressing the surface of the polishing pad 13. When the chemical-mechanical polishing station is carrying out a polishing action, the polishing table 10 and the wafer holder 11 each rotate independently in a pre-defined direction, for example, directions 18*a* and 18*b*, respectively.

The wafer holder 11, while gripping the backside 19 of the wafer 12, presses the front face 20 of the wafer 12 onto the polishing pad 13. The liquid pump 16 also works continuously to pump slurry 15 to the polishing pad 13 through the tube 14. The polishing action in a chemical-mechanical polishing operation relies on chemical reagents and the abrasive particles suspended in the slurry. The reagents react chemically with molecules on the front surface 20 of the wafer 12 to form an easy-grind layer, while the abrasive particles of the slurry 15 help to remove pointed peaks within the easy-grind layer. By continuous chemical reaction and repeated mechanical abrasion, a highly polished and planar surface is ultimately formed on the wafer surface.

The polishing table 10 rotates at a definite angular speed in the direction 18*a* shown in FIGS. 1A and 1B. However, the wafer 12 on the polishing pad 13 is polished a tangential speed that depends on the radial distance from the center of the circular table 10. This is because the actual polishing speed or tangential speed is the product of the angular speed and the radius. Since tangential speed increases proportionately from the center towards the perimeter of the polishing table, the amount of polishing received by the front surface 20 of the wafer 12 varies according to its location on the polishing pad 13. Consequently, the degree of planarity after the polishing operation may vary considerably due to differences in tangential polishing speed.

In light of the foregoing, there is a need to provide an improved polishing table design for a chemical-mechlanical polishing station capable of producing a highly planar wafer surface.

SUMMARY OF THE INVENTION

Accordingly, the present invention provides a chemical-mechanical polishing station capable of producing a uniform tangential polishing speed so that various parts of the wafer are polished at the same polishing rate. Hence, the degree of planarity on the surface of a wafer polished by the station is improved.

To achieve these and other advantages and in accordance with the purpose of the invenition, as embodied and broadly described herein, the invention provides a chemical-meclhanical polishing station. The polishing station includes a polishing table having a plurality of concentric rings all rotating in the same direction but separated from each other by a small gap so that a polishing table having the same tangential polishing speed everywhere across its surface is provided.

According to one preferred embodiment of this invention, a chemical-mechanical polishing station is provided. The polishing station includes a polishing table having a plurality of concentric rings all rotating in the same direction but separated from each other by a small gap, a plurality of circular polishing pads each similar in shape to one of the concentric rings and placed on top of the concentric rings, and a delivering tube positioned above the polishing pads but separated from the pad surface by a small distance. The delivering tube further includes a tube handle and a tube surface, and the tube surface has a number of holes drilled in it for distributing slurry evenly over the polishing pads.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
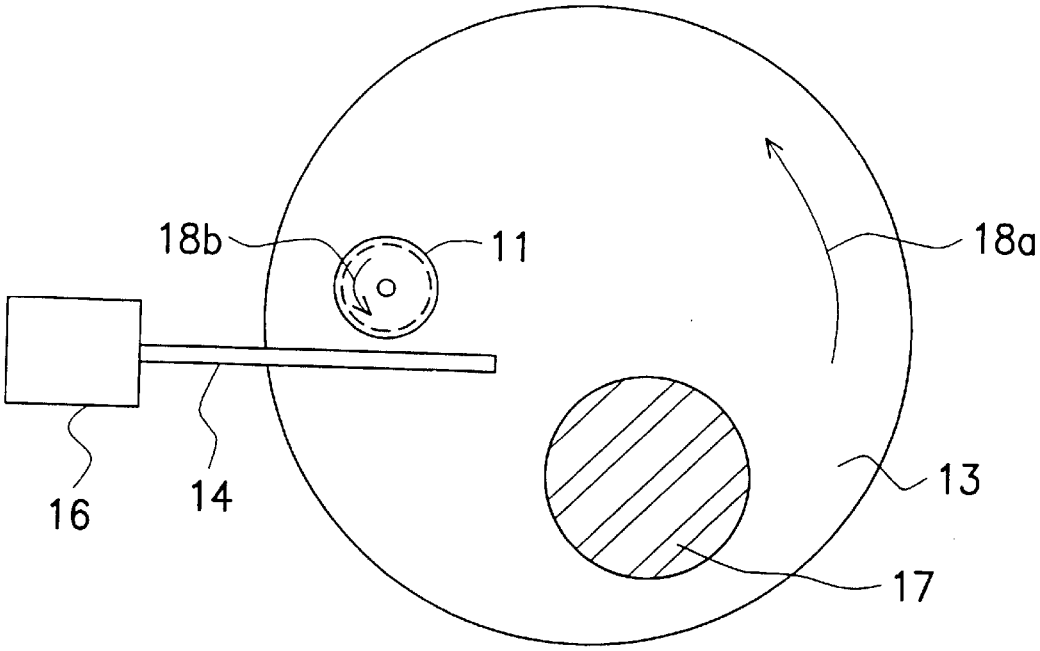
FIG. 1A (PRIOR ART)
FIG. 1A is a top view showing a conventional chemical-mechanical polishing station.
Figure 1B:
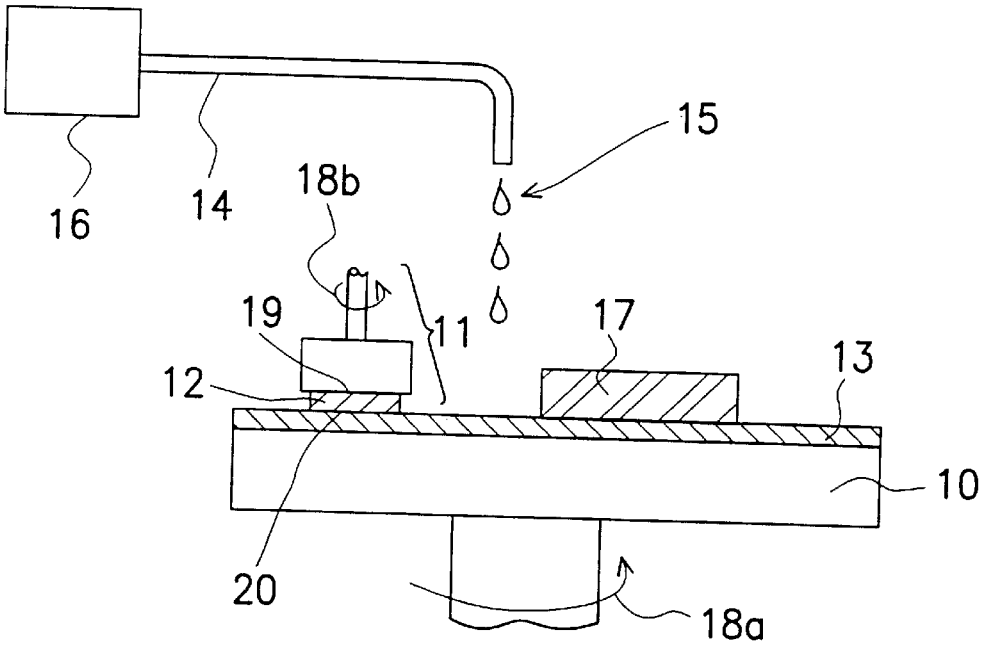
FIG. 1B (PRIOR ART)
FIG. 1B is a side view showing a conventional chemical-mechanical polishing station.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
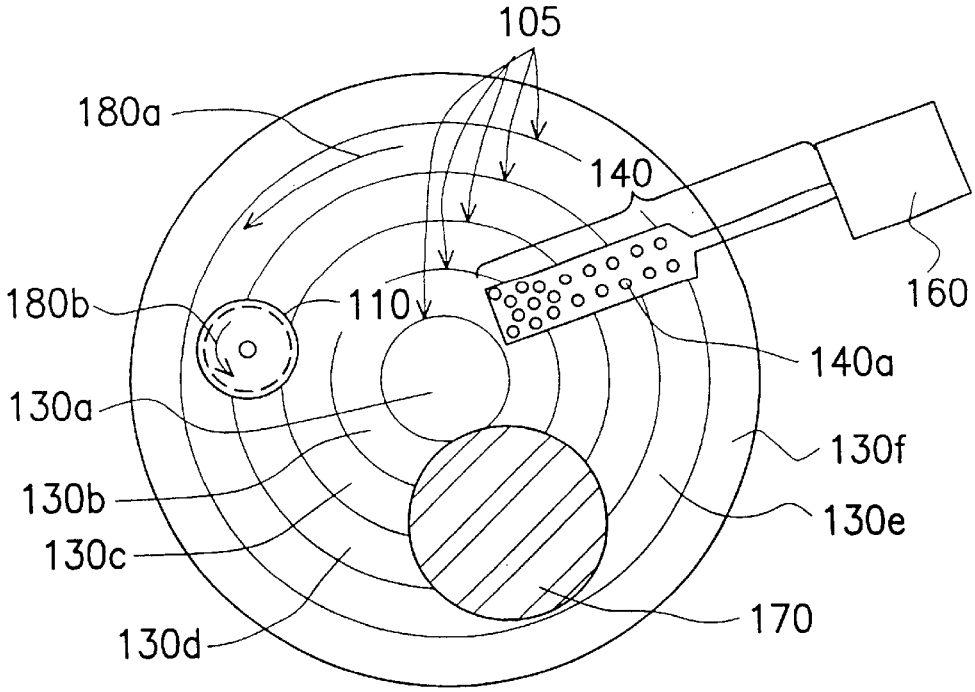
FIG. 2A is a top view showing a chemical-mechanical polishing station according to one preferred embodiment of this invention.
Figure 2B:
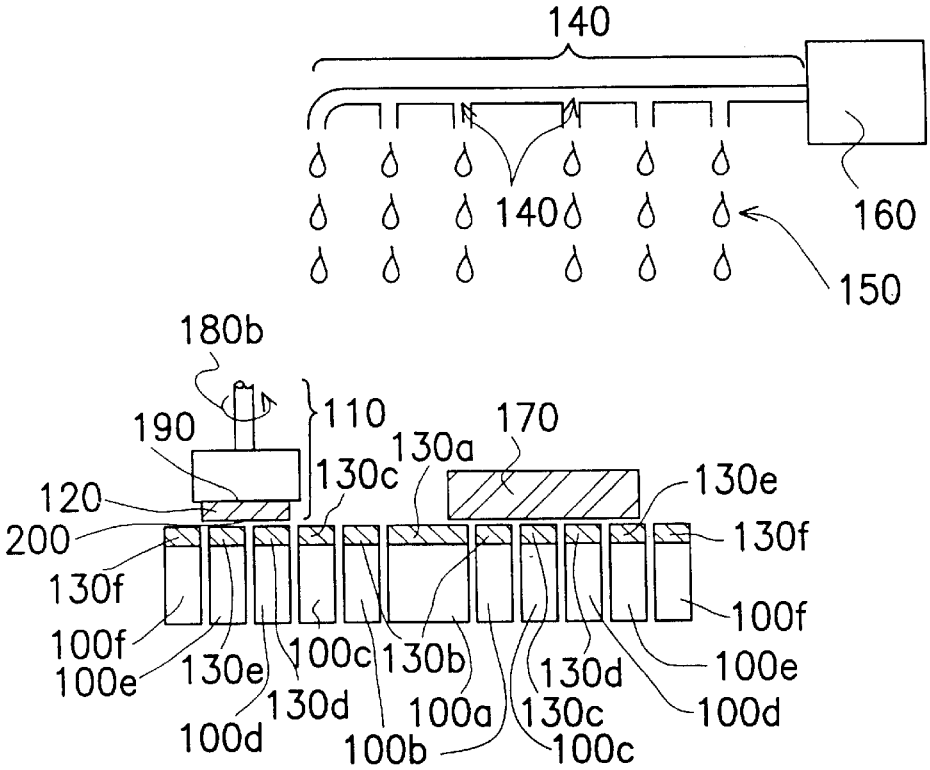
FIG. 2B is a cross-sectional side view showing a chemical-mechanical polishing station according to one preferred embodiment of this invention.

FIGS. 2A and 2B are the respective top view and cross-sectional side view of a chemical-mechanical polishing station according to one preferred embodiment of this invention. As shown in FIGS. 2A and 2B, the polishing station includes a polishing table having concentric rings 100*a*, 100*b*, 100*c*, 100*d*, 100*e* and 100*f* separated from each other by a gap 105 smaller than about 0.1 millimeter, a holder 110 for grasping the polishing wafer 120, a number of concentric polishing pads 130*a*, 13*b*, l3*c*, 130*d*, 130*e* and 130*f* covering concentric rings 100*a*, 100*b*, 100*c*, 100*d*, 100*e* and 100*f*, respectively, and a delivery tube 140 positioned over but at a distance from the polishing pads for transporting slurry to the polishing table.

The delivery tube 140 has a number of holes 140 drilled in it for distributing slurry 150 evenly and efficiently over the polishing pads. Furthermore, the polishing station also includes a liquid pump 160 for pumping slurry 150 to the delivery tube 140. and a conditioner 170 above the various polishing pads for re-conditioning the polishing pad surfaces and removing impurities on the polishing pads. The conditioner 170 is normally made from hard material including, for example, diamond dust.

In carrying out a chemical-mechanical polishing operation, the polishing rings 100*a*, 100*b*, 100*c*, 100*d*, 100*e* and 100*f* of the polishing table and the wafer holder 110 all rotate in pre-defined directions shown by arrows 180*a* and 180*b* in FIGS. 2A and 2B. The polishing rings 100*a*, 100*b*, 100*c*, 100*d*, 100*d*, 100*e* and 100*f* all rotate with different angular speeds such that the rings all have roughly the same tangential polishing speed. Since tangential polishing speed is the product of the angular speed and its radius, the speed of rotation of each ring can be adjusted according to the radius of the ring using the above product formula.

The wafer 120, the conditioner 170 and the delivery tube 140 are positioned around the polishing table following the direction of rotation of the concentric rings 18*a*. With the above setting, the delivery tube 140 can deliver slurry 150 more efficiently over the pad surfaces so that the wafer 120 can fully utilize the slurry 150 before passing on to the conditioner 170 for pad treatment. Consequently, slurry 150 does not accumulate around the conditioner 170, and hence some slurry 150 is saved.

The wafer holder 110 grasps the backside 190 of the wafer 120, and then the front face 200 of the wafer 120 is pressed against the polishing pads 130*c*, 130*d* and 103*e*. Next, slurry 150 is pumped through a liquid pump 160 to the delivery tube 140 and then continuously distributed over various polishing pads. The polishing action in a chemical-mechanical polishing operation relies on chemical reagents and abrasive particles suspended in the slurry.

The reagents react chemically with molecules on the front surface 200 of the wafer 120 to form an easy-grind layer, while the abrasive particles of the slurry 150 help to remove pointed peaks within the easy-grind layer. By continuous chemical reaction and repeated mechanical abrasion with the polishing pads, a highly polished and planar surface is ultimately formed at the wafer surface. If various processing parameters, such as uniformity of the slurry flow and quantity of slurry supplied, are under proper control, a degree of planarity of the polished surface up to and beyond 94% can be achieved. Design of the delivery tube 140 can control the uniformity of slurry flow and delivery rate of slurry so that an optimal polishing result can be obtained. Details of such delivery tube design can be found in another Taiwan Patent No. 87109281 by the same inventor.

In this invention, several concentric rings are used to form the polishing table so that roughly the same tangential polishing speed is obtained across the entire polishing surface. Consequently, the entire water surface is able to receive nearly linear polishing and therefore a higher degree of uniformity of the polished wafer surface is obtained. In general the number of concentric rings forming the polishing table depends on actual need. Preliminary experiments (data not included) show that optimal results are probably obtained when the number of concentric rings is within the range of 6 to 12.

Furthermore, according to the preferred embodiment of this invention, each of the concentric rings can have a polishing pad made from slightly different polishing material, depending on actual requirements. For example, material density, roughness and chemical composition can be independently changed in all or some of the polishing pads so that a higher degree of planarity on a polished wafer can be obtained.

In addition this invention also includes the mounting of a single polishing pad having concentric rings of slightly different material and/or density on a one-piece polishing table. Although a single tangential polishing speed is not achieved everywhere above the polishing pad with this design, variation of polishing properties in the radial direction improves the resulting polished surface.

In summary, major aspects of this invention include:

1. Several concentric rings are used to form the polishing table so that the same tangential polishing speed is obtained across the entire polishing surface. Consequently, the entire wafer surface is able to receive nearly linear polishing, and a higher degree of uniformity of the polished wafer surface is obtained.

2. Each of the concentric rings can have a polishing pad made from slightly different polishing material depending on actual requirement. For example, material density, roughness and chemical composition can be independently varied in all or some of the polishing pads so that a higher degree of planarity on the polished wafer surface is obtained.

3. Even for a polishing station with a one-piece polishing table, the formation of a polishing pad having concentric rings of slightly different material and/or density on a single polishing table will improve the polishing operation. Although a single tangential polishing speed is not achieved with this design, variation of polishing properties in the radial direction is able to improve the uniformity of polished wafer surface.

It will be apparent to those skilled in the art that various modifications and variations can be made to the structure of the present invention without departing from the scope or spirit of the invention. In view of the foregoing it is intended that the present invention cover modifications and variations of this invention provided they fall within the scope of the following claims and their equivalents.

What is claimed is:

1. A chemical-mechanical polishing station, comprising: polishing table having concentric rings, wherein the rings are separated from each other by a small gap and all rings are independently rotatable in a prescribed direction;

a plurality of polishing pads, wherein each polishing pad is mounted on top of a concentric ring; and a delivery tube positioned at a distance above the polishing pads.

2. The polishing station of claim 1, wherein the delivery tube further includes a tube handle and a tube surface, and the tube surface has a plurality of holes drilled in it for delivering slurry to the polishing pads.

3. The polishing station of claim 1, wherein the station further includes a water holder for grasping the backside of a wafer and pressing the front face of the wafer onto the polishing pad surface.

4. The polishing station of claim 1, wherein the station further includes a liquid pump connected to the delivery tube for pumping slurry to the tube.

5. The polishing station of claim 1, wherein all the concentric rings on the polishing table are capable of having the same tangential polishing speed.

6. The polishing station of claim 1, wherein the gap is smaller than about 0.1 millimeter.

7. The polishing station of claim 1, wherein the polishing pads are made from materials having different densities.

8. The polishing station of claim 1, wherein the polishing pads are made from materials having different surface roughnesses.

9. The polishing station of claim 1, wherein the polishing pads are made from materials having different chemical compositions.

* * * * *